US005256202A

United States Patent [19]

Hanamura et al.

[11] Patent Number: 5,256,202

[45] Date of Patent: Oct. 26, 1993

[54] TI-A1 INTERMETALLIC COMPOUND SHEET AND METHOD OF PRODUCING SAME

[75] Inventors: Toshihiro Hanamura; Munetsugu Matsuo; Toshiaki Mizoguchi; Kenichi Miyazawa; Masao Kimura; Naoya Masahashi, all of Kawasaki, Japan

[73] Assignee: Nippon Steel Corporation, Tokyo, Japan

[21] Appl. No.: 752,628

[22] PCT Filed: Dec. 25, 1990

[86] PCT No.: PCT/JP90/01691

§ 371 Date: Aug. 23, 1991

§ 102(e) Date: Aug. 23, 1991

[87] PCT Pub. No.: WO91/09697

PCT Pub. Date: Jul. 11, 1991

[30] Foreign Application Priority Data

Dec. 25, 1989 [JP] Japan ..... 1-335794
Dec. 25, 1989 [JP] Japan ..... 1-335797

[51] Int. Cl.[5] ..... C22C 14/00

[52] U.S. Cl. ..... 148/421; 148/669; 148/670; 420/418; 420/421

[58] Field of Search ..... 420/418, 421; 148/669, 148/670, 421

[56] References Cited

U.S. PATENT DOCUMENTS

| | | | |
|---|---|---|---|
| 4,842,819 | 6/1989 | Huang et al. | 420/418 |
| 4,857,268 | 8/1989 | Huang et al. | 420/407 |
| 4,941,928 | 7/1990 | Ammon et al. | 420/421 |
| 5,028,277 | 7/1991 | Mizoguchi et al. | 428/660 |

FOREIGN PATENT DOCUMENTS

| | | |
|---|---|---|
| 56-41344 | 4/1981 | Japan . |
| 59-581 | 1/1984 | Japan . |
| 61-41740 | 2/1986 | Japan . |
| 62-77151 | 4/1987 | Japan . |
| 2-224803 | 9/1990 | Japan . |

OTHER PUBLICATIONS

Metallurgical Transaction, vol. 6A, p. 1991(1975), "The Deformation And Fracture Of TiA1 At Elevated Tempertures", H. A. Lipsitt et al.

"Casting of Near Net Shape Products", Proceeding of an International Symposium on Casting of Near Net Shape Products, pp. 315 to 333, (1988).

*Primary Examiner*—Upendra Roy

*Attorney, Agent, or Firm*—Kenyon & Kenyon

[57] ABSTRACT

The present invention provides a Ti—Al intermetallic compound sheet of a thickness in the range of 0.25 to 2.5 mm formed of a Ti—Al intermetallic compound of 40 to 53 atomic percent of Ti, 0.1 to 3 atomic percent of at least one of material selected from the group consisting of Cr, Mn, V and Fe, and the balance of Al, and a Ti—Al intermetallic compound sheet producing method comprising the steps of pouring a molten Ti—Al intermetallic compound of the foregoing composition into the mold of a twin drum continuous casting machine, casting and rapidly solidifying the molten Ti—Al intermetallic compound to produce a thin cast plate of a thickness in the range of 0.25 to 2.5 mm and, when necessary, subjecting the thin cast plate to annealing and HIP treating. The Ti—Al intermetallic compound sheet has excellent mechanical and surface properties.

7 Claims, 3 Drawing Sheets after HIP

500μm before HIP

TI-A1 INTERMETALLIC COMPOUND SHEET AND METHOD OF PRODUCING SAME

TECHNICAL FIELD

The present invention relates to a Ti—Al intermetallic compound sheet and a method of producing the same, and more particularly, provides the Ti—Al intermetallic compound sheet of a structural material having light weight, heatresistance, high temperature strength, and other superior properties suitable for aeronautical and astronautical purposes, and a method of producing such the Ti—Al intermetallic compound sheet.

BACKGROUND ART

It is well known that the Ti—Al intermetallic compound has fairly mach the maximum high temperature specific strength of metallic materials, and further, is high in corrosion resistance and light in weight. Metallurgical Transaction, Vol. 6A, p.1991 (1975) reported that a hightemperature strength of 40 kg/mm$^2$ was obtained at 800° C. Therefore, it has been considered optimal to use these characteristics and apply the Ti—Al intermetallic compound to gas turbine components, valves and pistons of automobile engines and apply them to dies used at high temperature, bearing parts, etc.

The Ti—Al intermetallic compound has a composition range in a phase diagram, and at a Ti content of 40 to 52 atomic percent and an Al content of 60 to 48 atomic percent in a heat equilibrium state becomes a single phase of an $L1_0$ structure (basically, a face-centered tetragonal structure, but layers of Ti and Al are arranged intersectingly in the <001> direction). It has been found that an abnormal strengthening phenomenon occurs whereby the strength of the Ti—Al intermetallic compound in a single crystal state increase with an elevation of the temperature. It is known that the strength of the Ti—Al intermetallic compound in a polycrystalline state is not lowered under a high temperature, but the polycrystalline Ti—Al intermetallic compound has disadvantages of a low ductility in the temperature range of room temperature to about 700° C. (Japanese Examined Patent Publication No. Sho 59-581), and the hot rolling of the polycrstalline Ti—Al intermetallic compound is very difficult. Accordingly, near-net-shape casting techniques which gives close to the final product must be employed to produce Ti—Al intermetallic compound sheets.

Recently, rapid progress has been made in near-net-shape casting techniques and, particularly when processing metallic materials, have been progressively applied to producing stainless steel sheet etc. Various casting methods as sheet manufacturing techniques have been proposed, and among those previously proposed casting methods, it has been found that a twin-drum method is suitable for producing a continuous sheet having a uniform thickness.

As an exemplary application of the foregoing techniques to an intermetallic compounds, there is known the example of a Ni—Al intermetallic compound ($Ni_3Al$) having an improved ductility by adding a small amount of boron. This example is reported in the international conference being held in November 1988, on "Casting of Near-Net-Shape Products" (the proceedings of an International Symposium on Casting of Near Net Shape Products, pp.315-333, issued by The Metallurgical Society.). A Ti—Al intermetallic compound sheet producing method is also disclose in Japanese Patent Application No. Hei 1-50649.

Although the application of a direct sheet process to the obtaining of near-net-shape products has the advantage of a curtailment of the manufacturing processes, a rapid cooling of the cast sheet in the direct sheet manufacturing process produces defects, such as surface cracks and porosities, in the sheet.

Accordingly, it is important to eliminate those defects in sheets produced by direct casting, to ensure sound and highly reliable sheet products.

DISCLOSURE OF THE INVENTION

An object of the present invention is to provide a method of producing a sheet having desired characteristics by the near-net-shape casting of a Ti—Al intermetallic compound having an optimum composition and an optimum crystal structure. Although the direct casting method of producing a sheet in a near net shape has significant advantages including a curtailment of the processes, the direct casting method has disadvantages in that the sheet produced by the same method has an inferior workability and mechanical properties because the method does not include a forging process, which is effective for a satisfactory adjustment and control of the crystal structure of material forming the sheet.

Accordingly, it is important to achieve the optimum adjustment and control of the crystal structure in the casting process for forming an optimum crystal structure, to provide by direct casting a sheet product having satisfactory characteristics, such as an excellent workability and mechanical properties, and thus ensure a highly reliable sheet product.

Another object of the present invention is to provide a technique capable of preventing defects including surface cracks and porosities when producing a near-net-shape product by direct casting.

The inventors of the present invention made a study of ways in which to achieve the foregoing objects, and created the present invention on the basis of findings obtained by the study that a Ti—Al intermetallic compound having a specific composition and a specific crystal structure must be used to solve the problems in the direct near-net-shape casting method, and that the application of specific casting conditions, a heat treatment process subsequent to a casting process, and specific process subsequent to the heat treatment process, to the direct neat-net-shape casting method is effective.

A gist of the present invention is a cast sheet of a thickness in the range of 0.25 to 2.5 mm formed of a Ti—Al intermetallic compound of a ternary system containing Ti in a content in the range of 40 to 53 atomic percent, at least one of material selected from the group consisting of Cr, Mn, V and Fe in a content in the range of 0.1 to 3 atomic percent, and the balance of Al and unavoidable impurities, and formed by processing a cast plate having, in an as-cast state, a columnar crystal structure growing from the opposite surfaces toward the central portions or a mixed structure of the columnar crystal structure and an equiaxed crystal structure existing in a vicinity of a central portion of the cast plate.

Another gist of the present invention is a method of producing a sheet having an excellent quality without surface defects including surface cracks and porosities, comprising the steps of forming a thin cast plate by casting the Ti—Al intermetallic compound of the foregoing composition in a mold by a twin-drum continuous casting machine, cooling the thin cast plate to a room temperature by furnace cooling, if necessary, after holding the thin cast plate at a temperature in the range of 800° to 1000° C. for a predetermined time, and pressing the thin cast plate by a hot isostatic pressing process.

A cast structure favorable to plastic working will be described hereinafter.

In accordance with the present invention, the ascast solidified cast plate has the columnar crystal structure growing from the opposite surfaces toward the central portion of the mixed structure of the columnar crystal structure and the equiaxed crystal structure existing in the vicinity of the central portion of the cast plate. The columnar crystal structure has the following conformation.

In the Ti—Al intermetallic compound, a dual-phase eutectic texture of a $\gamma$-phase (Ti—Al intermetallic compound and $L1_0$ structure) and an $\alpha_2$-phase ($Ti_3Al$ intermetallic compound and $D0_{19}$ structure) can be obtained by changing the ratio of composition of Ti and Al. When the Ti—Al intermetallic compound of the foregoing composition consists of 40 to 53 atomic percent of Ti, 0.1 to 3 atomic percent of a tertiary element, and the balance of Al, a hexagonal crystal compound first crystallizes during the solidification from the molten state, and the hexagonal crystal crystallizes selectively with the {0001} face is arranged in parallel to the sheet face, namely, with the <0001> direction is arranged in parallel to the sheet thickness direction, when the molten compound is solidified at a suitable cooling rate. However, in a compound of this range of composition, the hexagonal crystals stable just under the solidification point, and a regular structural change into the $\gamma$-phase ($L1_0$ structure) occurs. At the time of these structural change, the <111> crystal orientation of the $L1_0$ structure becomes parallel to the <0001> direction of the hexagonal crystals. Accordingly, a Ti—Al intermetallic compound sheet of a composition having Ti and Al contents approximately equal to the Ti—Al stoichiometric ratio having the required texture, i.e., a texture with the <111> crystal orientation preferentially coinciding with the direction of thickness of the cast plate can be produced by cooling a cast Ti—Al intermetallic compound at an appropriate cooling rate. If 0.1 to 3.0 atomic percent of one or a plurality of the tertiary element, such as Cr, Mn, V or Fe, is added to this system, the crystal structure is made to shrink and become isotropic and the casting structure is made finer and a required strength over the temperature range of a room temperature to 1000° C. is secured without detriment to the required texture.

The foregoing effect is not obtained if the content of the tertiary element is less than 0.1 atomic percent, and the tertiary elements from compounds which deteriorate the ductility of the cast plate if the content of the additive element is greater than 3.0 atomic percent. Therefore, the content of the tertiary element or elements must be in the range of 0.1 to 3.0 atomic percent.

The hexagonal crystals of the cast plate are not formed in the preferential crystal orientation and the regular structural change for the $L1_0$ structure does not occur even if the cast plate is cooled at a highest cooling rate if the thickness of the cast plate is less than 0.25 mm, and a random nucleation of crystals occurs in the central portion of the cast plate and the desired structure is not formed even if the cast plate is cooled at a highest cooling rate if the thickness of the cast plate is grater than 2.5 mm. Therefore, the thickness of the cast plate must be in the range of 0.25 to 2.5 mm.

A method of casting such a thin cast plate will be described hereinafter.

A twin-drum continuous casting machine (hereinafter referred to simply as "casting machine"), in general has two cooling drums disposed with their axis in parallel to each other for rotation in opposite directions, respectively, and side dams disposed contiguously with the opposite ends of the cooling drums, respectively, to form a basin (mold) in combination with the cooling drums. A molten metal poured into the basin is cast to form a thin cast plate while the molten metal is cooled by the rotating cooling drums.

According to the present invention, a molten Ti—Al intermetallic compound is poured into the basin and the same is cast to produce a thin cast plate. Since the Ti—Al intermetallic compound has a low ductility, cracks are liable to form in the thin cast plate during solidification and cooling, the formation of oxides, which cause irregular solidification, in the meniscus must be suppressed. Therefore, the Ti—Al intermetallic compound must be melted and cast in the atmosphere of an inert gas, such as an Ar gas or He gas.

The directly cast thin cast plate is cooled slowly by, for example, furnace cooling, immediately after leaving the mold. The thin cast plate may be held at a predetermined temperature for a predetermined time or may be subjected to HIP, if necessary.

Thus, a sheet of an excellent quality having neither surface cracks nor porosities can be produced.

When casting the thin cast plate by such a process, it is desirable to cool the thin cast plate at a cooling rate in the range of $10^{2°}$ C./sec to $10^{5°}$ C./sec. The cooling rate of $10^{5°}$ C./sec is the upper limit of cooling rate for solidifying the Ti—Al intermetallic compound in hexagonal crystals and for causing a regular structural change to form an $L1_0$ structure. If the cooling rate is less than $10^{2°}$ C./sec, a random nucleation of crystals occurs and the preferred nature of the crystal orientation is lost.

The thin cast plate is cooled at a cooling rate of up to 200° C./hr to a temperature not higher than 200° C., to prevent the development of surface cracks. Nevertheless, the thin cast plate may be held at a temperature in the range of 800° to 1000° C. for a time of in the range of 1 to 20 minutes after solidification, to curtail the time required for slow cooling. The above holding temperature is a necessary temperature to prevent the development of cracks due to thermal stress. The holding means are as follows, namely, a heating furnace may provided near a position where the thin cast plate leaves the mold or the cooling drums may be stopped to solidify the molten metal partly in a bulk form at above the cooling drums before the thin cast plate leaves the mold completely, so that thin cast plate is suspended from above the cooling drums.

The HIP treatment is carried out to crush to porosities (voids) in the cast plate, in which the cast plate is held at a temperature in the range of 1000° to 1400° C. (a temperature below the melting point) for a time in the range of ten minutes to one hour in an atmosphere of a pressure not lower than 1000 atm.

Thus, a Ti—Al intermetallic compound sheet having excellent mechanical properties and not having surface and internal defects can be produced.

BEST MODE OF CARRYING OUT THE INVENTION

A best mode of carrying out the present invention will be described with reference to preferred embodiments thereof.

DESCRIPTION OF THE PREFERRED EMBODIMENTS

Each of mixtures of aluminum, titanium sponge and other element or elements, such as Cr, Mn, V or Fe, respectively having compositions shown in Table 1 was melted in a plasma arc furnace to obtain mother alloys.

Figure 1:
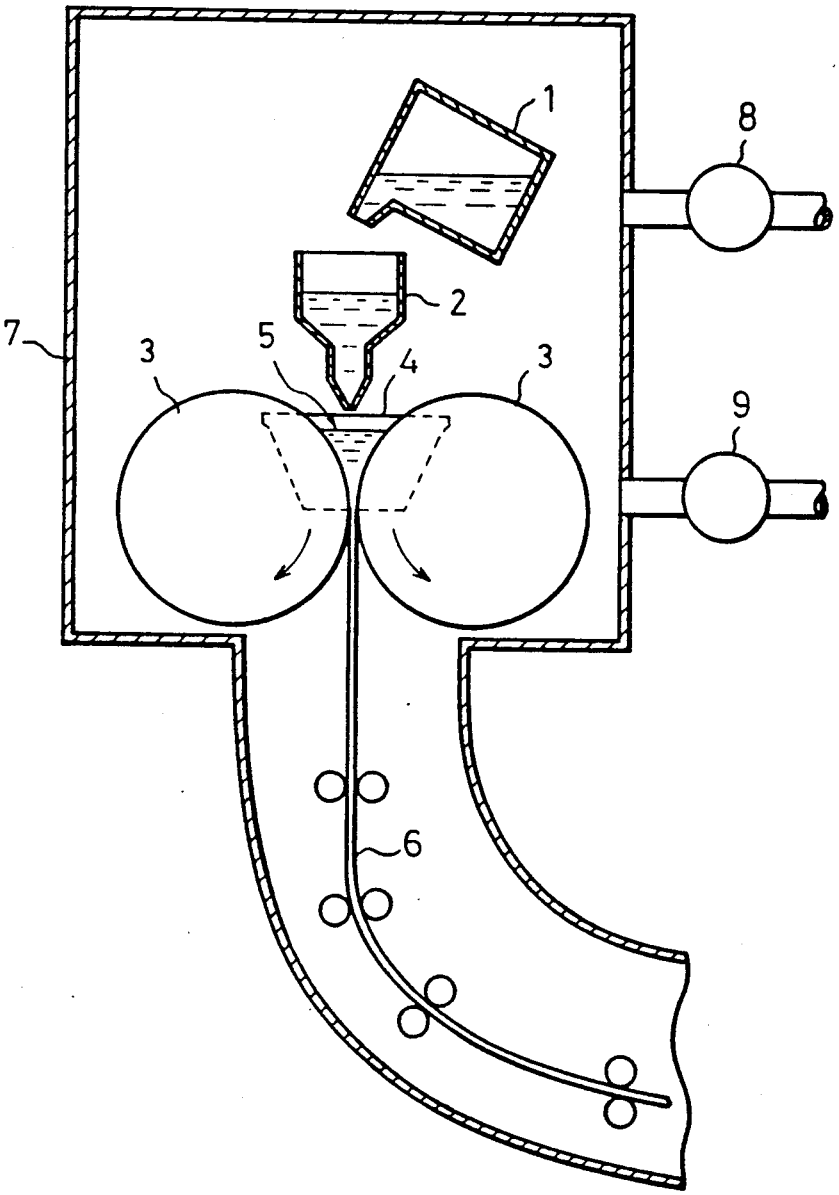
FIG. 1 is a schematic sectional side view of an apparatus for carrying out the present invention.

The molten mother alloys were cast by a casting machine shown in FIG. 1 to produce thin cast plates. As shown in FIG. 1, the casting machine comprises a turndish 2 for uniformly pouring a molten metal, disposed under a crucible 1 for melting a Ti—Al intermetallic compound, a basin 5 comprised by side dams 4 and the cooling drums 3 (mold) and disposed under the turndish 2, an atmosphere adjusting vessel 7 containing the foregoing components, an inert gas supply mechanism 8, and a discharge mechanism 9.

turndish 2 into the basin 5. The cooling drums 3 are a pair of drums of 300 mm in diameter and 100 mm in length formed of a copper alloy. The cooling drums 3 are cooled internally, therefore the molten mother alloys were cooled rapidly for solidification under a predetermined force supporting by the drams and at a cooling rate of $10^{3}$° C./sec to produce continuous thin cast plates 6 respectively having thickness tabulated in Table 1.

Figure 2:
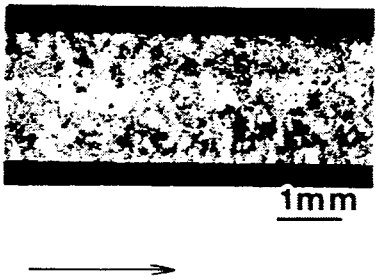
FIG. 2 is a metallographic photograph of a section of a cast plate produced by a method in accordance with the present invention taken along a casting direction.

FIG. 2 is a photograph of a section structure of one of the thin cast plates, i.e., Specimen No. 7, taken along the casting direction. The as-cast solidification structure of said plates was consisted of only columnar crystals oriented from the opposite surfaces of the thin cast plate toward the central portion of the same or a mixed structure consisting of the columnar crystals and equiaxed crystals formed in the central portion of the thin cast plate.

As stated above, the microstructure of the thin cast plate produced by the method in accordance with the present invention was a refined laminated composite structure of structures with the preferential orientation of the <111> crystal orientation of the $L1_0$ structure in the direction of the thickness of the thin cast plate and of the <0001> direction of the $D0_{19}$ structures. Moreover, the tertiary element, such as Cr, contained in the Ti—Al intermetallic compound, then the above laminated composite structure was very fine; the width of a layer of each $L1_0$ structure was 1000 Å and that of the $D0_{19}$ was 100 Å.

On the other hand, Specimen No. 1, which contains no tertiary element, also had a laminated microstructure, however, the width of a layer of each the component structures was 10000 Å and 1000 Å, and the laminated structure was coarse compared with the laminated structure of the thin cast plate formed of the Ti—Al intermetallic compound in accordance with the present invention.

The cast plate 6 delivered from the cooling drums 3, 3 was cooled at a low cooling rate of 1° C./sec in the atmosphere adjusting vessel 7, was inserted in a furnace,

TABLE 1

| Sample Nos. | Composition (at. %) | Drum supporting force (kgf) | Weight of mother alloy (g) | Secondary cooling (°C., min) | Surface property | Thickness (mm) | Continuous length (mm) | Remarks |
|---|---|---|---|---|---|---|---|---|
| 1 | 52Ti48Al | 1000 | 3500 | 1000, 30 | Cross mark | 1.51 | 150-680-850-440 | Comparative examples |
| 2 | 52Ti48Al | 1000 | 2000 | 1000, 10 | Cross mark | 1.58 | 2070 | |
| 3 | 52Ti48Al | 1000 | 2100 | 950, 10 | Good | 1.54 | 2170-380-230-30 | |
| 4 | 52Ti48Al | 1000 | 2000 | 900, 10 | Good | 1.58 | 2310-230 | |
| 5 | 52Ti48Al | 1000 | 2000 | 850, 10 | Good | 1.55 | 2500 | |
| 6 | 52Ti48Al | 1000 | 2000 | 800, 10 | Good | 1.55 | 1680-480 | |
| 7 | 50Ti48Al2Cr | 1000 | 3500 | 1000, 10 | Good | 1.51 | 2400 | Examples |
| 8 | 50Ti48AlMn | 1000 | 2000 | 1000, 10 | Good | 1.58 | 2070 | |
| 9 | 50Ti48Al2V | 1000 | 2100 | 1000, 10 | Good | 1.54 | 2220-380 | |
| 10 | 50Ti48AlFe | 1000 | 2000 | 1000, 10 | Good | 1.58 | 2300-200 | |
| 11 | 50Ti47Al3Cr | 1000 | 2000 | 1000, 10 | Good | 1.55 | 2400 | |
| 12 | 50Ti47Al3Mn | 1000 | 2000 | 1000, 10 | Good | 1.55 | 2480 | |
| 13 | 50Ti47Al1.5Cr1.5Mn | 1000 | 2000 | 1000, 10 | Good | 1.55 | 2000 | |

Each of the mother alloys of a weight in the range of 2000 to 3500 g shown in Table 1 was poured into the crucible 1 and was melted in an Ar atmosphere by heating the mother alloy at 1600° C., the temperature of the molten mother alloy was adjusted to 1500° C., and then the molten mother metal was poured through the opening of 4 mm in width and 95 mm in length formed in the not shown, and treated by a secondary cooling conditions shown in Table 1 at the furnace, and the furnace then disconnected from the power source and the cast plate 6 was cooled to a temperature below 200° C. by furnace cooling.

Table 2 shows the mechanical properties (elongation (%)) at a room temperature and at a high temperature of the cast plates thus produced. The cast plates formed of Ti—Al intermetallic compounds in accordance with the present invention have high elongations both at the room temperature and at the high temperature, compared with those of comparative examples.

Figure 3A:
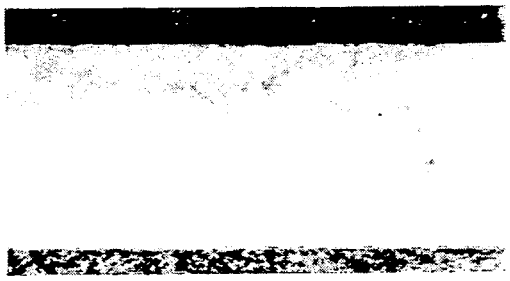
FIGS. 3(A) and 3(B) are photographs of the surface of a cast plate in accordance with the present invention cooled by furnace cooling after casting, and the surface of a cast plate in accordance with the present invention cooled by natural cooling after casting, respectively.
Figure 3B:
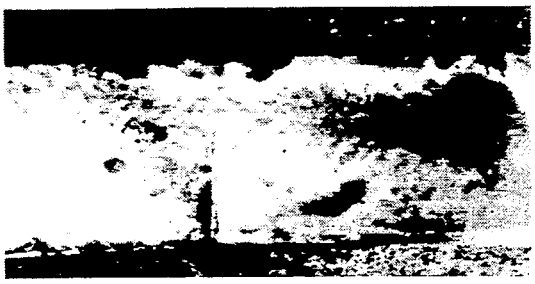

FIGS. 3(A) and 3(B) show the surface properties of the cast plate in Specimen No. 7 cooled respectively by furnace cooling and by natural cooling after leaving the cooling drums. Few surface cracks were found in the surface of the cast plate cooled at a relaxation cooling rate, whereas minute surface cracks were found in the surface of the cast plate cooled by natural cooling.

The surface properties of the cast plates by furnace cooling of each specimen were shown in Table 1. The specimens in accordance with the present invention had satisfactory surface properties.

The cast plates were subjected to a HIP of 1000° C. and 1500 atm. after cooling the same to a temperature below 200° C., and their rupture stress (three-point bending strength) was measured. Measured results are shown in Table 3. The rupture stress of specimens in accordance with the present invention were higher than that of the comparative examples, and it was confirmed that the HIP greatly enhances the rupture stress.

TABLE 2

| Sample Nos. | Composition (at. %) | Cold elongation (room temperature) | Hot elongation (800° C.) | Remarks |
|---|---|---|---|---|
| 1 | 52Ti48Al | 1.4 | 12 | Comparative examples |
| 2 | 52Ti48Al | 1.5 | 13 | |
| 3 | 52Ti48Al | 1.4 | 12 | |
| 4 | 52Ti48Al | 1.5 | 12 | |
| 5 | 52Ti48Al | 1.4 | 12 | |
| 6 | 52Ti48Al | 1.5 | 11 | |
| 7 | 50Ti48Al2Cr | 1.9 | 20 | Examples |
| 8 | 50Ti48Al2Mn | 1.7 | 20 | |
| 9 | 50Ti48Al2V | 1.7 | 18 | |
| 10 | 50Ti48Al2Fe | 1.7 | 17 | |
| 11 | 50Ti47Al3Cr | 1.9 | 22 | |
| 12 | 50Ti47Al3Mn | 1.8 | 21 | |
| 13 | 50Ti47Al1.5Cr1.5Mn | 1.8 | 20 | |

TABLE 3

| Sample Nos. | Composition (at. %) | Rupture stress (kg/mm²) As-cast (annealed) | Rupture stress (kg/mm²) After HIP | Remarks |
|---|---|---|---|---|
| 1 | 52Ti48Al | 65.2 | 70.0 | Comparative examples |
| 6 | 52Ti48Al | 55.3 | 69.0 | |
| 7 | 50Ti48Al2Cr | 79.5 | 97.3 | Examples |
| 8 | 50Ti48Al2Mn | 77.9 | 85.8 | |
| 9 | 50Ti48Al2V | 75.2 | 90.7 | |
| 10 | 50Ti48Al2Fe | 76.8 | 100.2 | |
| 11 | 50Ti47Al3Cr | 65.0 | 102.4 | |
| 12 | 50Ti47Al3Mn | 76.9 | 89.2 | |
| 13 | 50Ti47Al1.5Cr1.5Mn | 75.0 | 100.0 | |

TABLE 4

| Sample Nos. | Composition (at. %) | Elongation (1200° C., 5 × 10⁻⁴/sec) AS-cast (annealed) | Elongation (1200° C., 5 × 10⁻⁴/sec) After HIP | Remarks |
|---|---|---|---|---|
| 1 | 52Ti48Al | 20.0 | 30.0 | Comparative example |
| 7 | 50Ti48Al2Cr | 30.0 | 100.5 | Examples |

TABLE 4-continued

| Sample Nos. | Composition (at. %) | Elongation (1200° C., 5 × 10⁻⁴/sec) AS-cast (annealed) | Elongation (1200° C., 5 × 10⁻⁴/sec) After HIP | Remarks |
|---|---|---|---|---|
| 11 | 50Ti47Al3Cr | 25.0 | 102.0 | |

Figure 4A:
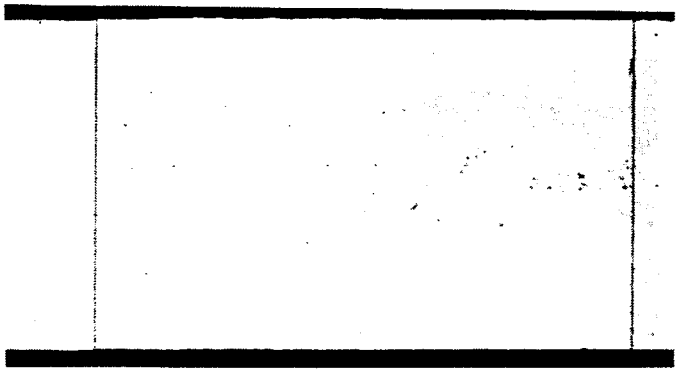
FIGS. 4(A) and 4(B) are photographs of a section of a Ti—Al intermetallic compound cast plate after being treated by a HIP, and a section of the same Ti—Al intermetallic compound cast plate before subjection the same to the HIP, respectively.
Figure 4B:
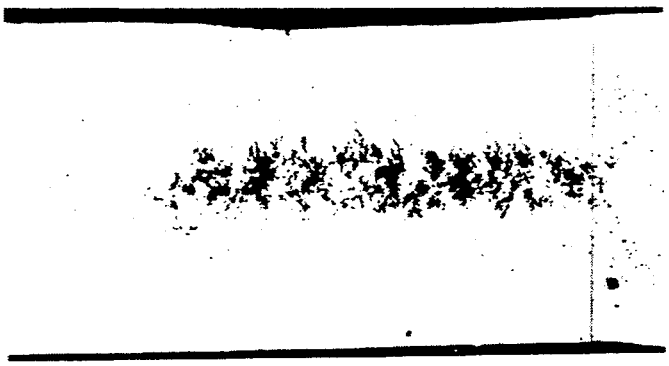

A specimen consisted of 50 atomic percent Ti and 50 atomic percent Al was processed by a HIP of 1250° C. and 1500 atm. for one hour to examine the porosities removing effect of the HIP. The result of this was shown in FIG. 4(A). It is known that almost all the porosities of the same before the HIP were removed by the HIP.

The hot workability (1200° C., strain rate of $5\times10^{-4}$/sec) of Specimens Nos. 7 and 11 containing Cr was examined. The elongation of the specimens processed by the HIP was not less than 100%, which obviously is different from that of Specimen 1, i.e., a comparative example.

Thus, the present invention greatly improves the mechanical properties of the cast plates or processed sheets, which is inferred to be due mainly to the fining effect of the tertiary element on the texture of the Ti—Al intermetallic compound, the holding treatment of the cast plate and the HIP treatment.

CAPABILITY OF EXPLOITATION IN INDUSTRY

As apparent from the foregoing description, a rapidly solidified thin cast plate produced by a method in accordance with the present invention and a sheet produced by processing the same thin cast plate are far superior to the conventional thin cast plate in mechanical properties and surface properties. Furthermore, the present invention provides a novel method of producing a material difficult to work, which has a high utility in industry.

We claim:

1. A Ti—Al intermetallic compound sheet of a thickness in the range of 0.25 to 2.5 mm formed by processing a thin cast plate of a Ti—Al intermetallic compound of 40 to 53 atomic percent of Ti, 0.1 to 3 atomic percent of at least one material selected from the group consisting of Cr, Mn, V and Fe, and the balance Al and unavoidable impurities, having in an as-cast solidified state, a columnar crystal structure which consists of the <111> crystal orientation oriented preferentially in the direction from the opposite surfaces of the cast plate toward the central portion of the same, and is formed of a refined composite structure of $L1_0$ structures and $D0_{19}$ structures.

2. A Ti—Al intermetallic compound sheet according to claim 1, wherein the as-cast solidified thin cast plate has a mixed structure of a columnar crystal structure extending from opposite surfaces thereof toward a central portion thereof, and equiaxed crystals existed in a vicinity of the central portion thereof.

3. A method of producing a Ti—Al intermetallic compound sheet, comprising steps of: pouring a melt of the Ti—Al intermetallic compound of 40 to 53 atomic percent of Ti, 0.1 to 3 atomic percent of at least one of material selected from the group consisting of Cr, Mn, V and Fe, and the balance of Al and unavoidable impurities into the mold of a twin-drum continuous casting machine in an inert gas atmosphere and casting the thin cast plate of a thickness in the range of 0.25 to 2.5 mm by cooling the melt by the two drums and cooling the cast plate immediately after the cast plate has left the two drums to a temperature not higher than 200° C. at a cooling rate not higher than 200° C./sec.

4. A method of producing a Ti—Al intermetallic compound sheet according to claim 3 further comprising a step of subjecting the cast plate cooled to a temperature not higher than 200° C. to hot isostatic pressing at an atmosphere of a temperature of 1000° C. or higher and a pressure of 1000 atm or higher.

5. A method of producing a Ti—Al intermetallic compound sheet according to claim 3, wherein the cast plate is cooled by the two drums at a cooling rate in the range of $10^{2}$° C./sec to $10^{5}$° C./sec.

6. A method of producing a Ti—Al intermetallic compound sheet according to claim 4 further comprising a step of hot working at a temperature in the range of 1200 to 1400° C. at a low strain rate of $5\times10^{-4}$/sec or below after carrying out the hot isostatic pressing to the cast plate.

7. A method of producing a Ti—Al intermetallic compound sheet according to claim 3 or 4, the cast plate is held at a temperature in the range of 800° to 1000° C. for a time in the range of 1 to 20 minutes immediately after the cast plate has left the two drums, and then the cast plate is cooled to a room temperature at a cooling rate of 200° C./sec or below.

* * * * *